United States Patent [19]

Ostwald et al.

[11] Patent Number: 4,692,356

[45] Date of Patent: Sep. 8, 1987

[54] PROCESS FOR METALLIZING A SOLID BODY

[75] Inventors: Robert Ostwald, Ulm; Gabriele Voit, Biberach, both of Fed. Rep. of Germany

[73] Assignee: Licentia Patent-Verwaltungs-GmbH, Frankfurt am Main, Fed. Rep. of Germany

[21] Appl. No.: 703,679

[22] PCT Filed: Jul. 18, 1984

[86] PCT No.: PCT/EP84/00223

§ 371 Date: Feb. 11, 1985

§ 102(e) Date: Feb. 11, 1985

[87] PCT Pub. No.: WO85/00623

PCT Pub. Date: Feb. 14, 1985

[30] Foreign Application Priority Data

Jul. 21, 1983 [DE] Fed. Rep. of Germany ..... 3326253

[51] Int. Cl.[4] ..... B05D 3/10

[52] U.S. Cl. ..... 427/304; 427/305; 427/306; 427/404; 427/430.1; 204/30

[58] Field of Search ..... 427/304–306, 427/404, 430.1; 204/30

[56] References Cited

U.S. PATENT DOCUMENTS

| | | | |
|---|---|---|---|
| 3,889,017 | 6/1975 | Franz | 427/305 |
| 4,307,168 | 12/1981 | Lelental et al. | 427/304 |
| 4,322,457 | 3/1982 | Baron et al. | 427/304 |
| 4,354,911 | 10/1982 | Dodd et al. | 427/304 |
| 4,444,848 | 4/1984 | Shanefield et al. | 427/304 |

*Primary Examiner*—Norman Morgenstern
*Assistant Examiner*—Janyce H. Bell
*Attorney, Agent, or Firm*—Spencer & Frank

[57] ABSTRACT

To metallize a preferably glass-like body with good adhesion of the metal, the glass-like body is coated with a thin layer of an indium-tin alloy, whereupon a catalytic germination layer is produced for currentless chemical metal precipitation by reducing a catalyst metal compound to the catalyst metal directly by the indium-tin layer or after the indium-tin layer has been reacted by salt formation or hydrolysis. After currentless chemical metallization, reinforcement may continue by electroplating with conventional metals.

11 Claims, No Drawings

PROCESS FOR METALLIZING A SOLID BODY

BACKGROUND OF THE INVENTION

The invention relates to a process for metallizing a solid body, in particular, a vitreous, glass-like surface containing a silicate material.

Solid bodies are metallized to change, improve and/or broaden their functional characteristics, e.g. their electrical conductivity, corrosion resistance, wear resistance and/or also their decorative characteristics. Generally, the adhesive strength of such metallizations is of great significance. The adhesion of a layer may be effected, for example, by relatively weak interaction between the materials of the layer and of the substrate (so-called Van der Waals forces), by chemical bonds or by mechanical anchoring and/or a combination of such contributions.

Processes are known with which layer adhesion can be improved. For example, adhesion promoting intermediate layers may be precipitated in the form of adhesives or as vapor-deposited and/or sputtered layers. Better layer adhesion is realized by roughening the substrate, e.g. in a grinding process, and/or by swelling and roughening the surface by way of chemical etching and/or by embedding dissolvable impurities in the adhesion promoter.

These known processes are limited to certain applications and special combinations of materials. Adhesion promoters are composed of a material which is different from the substrate and from the desired coating, so that incompatible characteristics occur or the desired layer characteristics must be restricted. For example, adhesion promoters in adhesive layers reduce the thermal stressability of the coated bodies. Inorganic adhesion promoters require uneconomical coating processes. Roughened substrate surfaces are annoying wherever very fine metallization structures are required or where there is a demand for special optical characteristics, such as reflection.

SUMMARY OF THE INVENTION

It is the object of the invention to provide a process of this type which permits, in particular, a very finely structured and well adhering metallization to be produced in an economical manner on a vitreous and/or glass-like body and wherein roughening of the surface of the body and the precipitation of a special adhesion promoter are avoided.

To metallize a preferably glass-like body with good adhesion of the metal, the glass-like body is coated with a thin layer of an alloy, such as indium-tin, whereupon a catalytic germination layer is produced for currentless chemical metal precipitation by reducing a catalyst metal compound to the catalyst metal directly by the, for example, indium-tin layer or after the indiumtin layer has been reacted by salt formation or hydrolysis. After currentless chemical metallization, metal deposition may be continued by electroplating with conventional metals.

DETAILED DESCRIPTION OF THE EMBODIMENTS

This is accomplished, according to the invention, by applying a first layer containing at least one metal and/or metal oxide to the cleaned surface of the solid body in such a manner that a subsequently applied catalytic metal compound is reduced to form a metal catalytic germination layer by the metal contained in the first layer, and/or by a metal salt layer, hydrolized metal salt layer, or oxide layer formed by reacting the first layer. Thereafter, a metal is deposited on the germination layer by either a currentless chemical process, electroplating or both. Suitable embodiments and other features include: selecting the metal in the first layer from groups IIb through Vb of the periodic table; converting the first layer to a light permeable layer by chemical reaction and applying the first layer to a thickness of from 10 nm to 1000 nm. In a preferred embodiment the silicate material comprises soda lime glass, borosilicate glass, or both; and the first layer comprises an indium-tin alloy, its oxide, or both. Preferably, the ratio of indium to tin is from 100 to 0.01.

Moreover, at least part of the metal layer forming the first layer may be converted to a metal salt layer by chemical reaction with an acid. Additionally, the metal salt layer can be converted to an hydroxide containing layer by chemical reaction with water.

The invention will be explained in greater detail below with the aid of examples thereof.

EXAMPLE 1

On a disc-shaped body of soda lime glass, after using conventional cleaning and degreasing methods, a first layer of an indium-tin alloy is vapor-deposited in a cathode sputtering system to a thickness of 120 nm. Treatment in a palladium chloride solution and subsequent thorough rinsing in demineralized water produce a catalytic germination layer on which, in a presently commercially available chemical copper bath, a very uniform copper layer can be deposited. After tempering, this layer is reinforced with copper by electroplating. With the aid of a conventional photolacquering and etching method, strips of 1 mm in width are prepared which require a pulling force of 0.2 N to be peeled off perpendicularly.

EXAMPLE 2

A disc of borosilicate glass is pretreated as in Example 1 and an indium-tin alloy layer is vapor-deposited thereon. By way of a tempering process in air, the layer is converted by oxidation to a light permeable layer. After gas phase pickling and subsequent hydrolysis, a catalytic germination layer is formed by means of a palladium chloride solution. After precipitation of a copper layer of 0.3 microns from a presently commercially available chemical copper bath, tempering takes place with the exclusion of oxygen. After reinforcing the layer by electroplating and subjecting it to a strip peeling preparation process according to Example 1, a peeling resistance of 0.45 N/mm is measured.

We claim:

1. Process for metallizing a solid body having a cleaned non-metallic surface comprising:

(a) applying a first layer comprising at least one material selected from the group consisting of at least one alloy of indium-tin and at least one oxide of an alloy of indium-tin to the cleaned surface of a non-metallic solid body, said at least one alloy of indium-tin comprising the first layer being selected such that a subsequently applied catalyst metal compound is reduced to the catalyst metal by it;

(b) depositing at least one catalyst metal compound onto the first layer;

(c) allowing the catalyst metal compound to be reduced by the first layer to a catalyst metal, thereby forming a catalytic germination layer; and (c) depositing a metal by a process selected from the group consisting of a currentless chemical process and the process of electroplating onto the catalytic germination layer.

2. Process for metallizing a solid body according to claim 1, wherein the first layer is converted by oxidation to a light permeable layer.

3. Process for metallizing a solid body according to claim 1, wherein the indium-tin alloy has an indium to tin ratio in the range of 100 to 0.01.

4. Process for metallizing a solid body according to claim 1, wherein the first layer is applied in a thickness which lies within the range of 10 nm to 1000 nm.

5. Process for metallizing a solid body according to claim 1, wherein the catalyst metal initiates a currentless chemical metal precipitation.

6. Process for metallizing a solid body according to claim 1, wherein the first layer comprises a thin metal coating that reduces the catalyst metal compound to the catalyst metal.

7. Process for metallizing a solid body according to claim 6, wherein at least part of the first layer is converted to a metal salt layer by chemical reaction with an acid.

8. Processs for metallizing a solid body according to claim 7, wherein the metal salt containing layer is converted to a hydroxide containing layer by chemical reaction with water.

9. Process for metallizing a solid body according to claim 1; wherein the solid body has a vitreous surface comprising a silicate material.

10. Process for metallizing a solid body according to claim 9, wherein the silicate material is at least one material selected from the group consisting of a soda lime glass and a borosilicate glass.

11. Process for metallizing a solid body according to claim 1, wherein the first layer is reacted to form at least one metal compound selected from the group consisting of one or more metal salts, one or more hydrolized metal salts and one or more metal oxides, before applying the catalyst metal compound.

* * * * *